US007883237B2

(12) United States Patent
Zhang et al.

(10) Patent No.: US 7,883,237 B2
(45) Date of Patent: Feb. 8, 2011

(54) HEAT EXTRACTOR DEVICE FOR FLUORESCENT LIGHTING FIXTURE

(75) Inventors: John Zhang, Concord, CA (US); Peter Y. Y. Ngai, Alamo, CA (US); Qirong Cao, Albany, CA (US)

(73) Assignee: ABL IP Holding, LLC, Conyers, GA (US)

( * ) Notice: Subject to any disclaimer, the term of this patent is extended or adjusted under 35 U.S.C. 154(b) by 0 days.

(21) Appl. No.: 11/541,425

(22) Filed: Sep. 28, 2006

(65) Prior Publication Data

US 2007/0109777 A1 May 17, 2007

Related U.S. Application Data

(60) Provisional application No. 60/721,890, filed on Sep. 28, 2005.

(51) Int. Cl.
*F21V 7/20* (2006.01)
*F21S 4/00* (2006.01)

(52) U.S. Cl. ..... 362/218; 362/219; 362/294; 362/373

(58) Field of Classification Search ..... 362/217, 362/218, 294, 373
See application file for complete search history.

(56) References Cited

U.S. PATENT DOCUMENTS

| | | | | |
|---|---|---|---|---|
| 2,966,602 | A | 12/1960 | Waymouth et al. | |
| 3,112,890 | A | 12/1963 | Snelling | |
| 3,192,724 | A | 7/1965 | Cummings | |
| 3,965,345 | A * | 6/1976 | Fordsmand | 362/218 |
| 4,070,570 | A | 1/1978 | Wetmore et al. | |
| 4,449,071 | A | 5/1984 | Yokoyama | |
| 4,533,853 | A | 8/1985 | Hammond et al. | |
| 4,533,854 | A | 8/1985 | Northrup | |
| 5,581,157 | A | 12/1996 | Vrionis | |
| 5,612,593 | A | 3/1997 | Olson | |
| 5,720,548 | A | 2/1998 | Geary | |
| 6,024,465 | A * | 2/2000 | Kobayashi | 362/218 |
| 6,411,042 | B1 | 6/2002 | Cull et al. | |
| 6,578,988 | B2 | 6/2003 | Johnson et al. | |
| 6,682,381 | B1 | 1/2004 | Michael | |
| 7,284,878 | B2 * | 10/2007 | Dorogi et al. | 362/218 |
| 2006/0120072 | A1 | 6/2006 | Dorogi et al. | |

* cited by examiner

*Primary Examiner*—Sandra L O Shea
*Assistant Examiner*—Sean P Gramling
(74) *Attorney, Agent, or Firm*—Beeson Skinner Beverly, LLP

(57) ABSTRACT

A lamp heat extractor device for lowering the cold spot temperature of a fluorescent lamp includes a base portion adapted to be attached to a heat conductive portion of the fluorescent lighting fixture proximate the fixture's lamp socket or sockets, and an extended sleeve end portion thermally connected to the base portion by a conductive connector portion. The conductive connector portion positions the extended sleeve portion so that it contacts the cold spot end of the fluorescent lamp or lamps held by the lamp sockets of the fixture to allow heat transfer to the fixture housing to which the heat extractor device is attached. Suitably, the outer surface of the extended sleeve end portion of the heat extractor device can have a plurality of radially extending fins for increasing surface area for heat radiation from the extended sleeve portion, thereby increasing the overall heat extracting efficiency of the device. The device can have two or more sleeve ends thermally interconnected to the base portion for contacting the cold spot ends of two or more fluorescent lamps.

31 Claims, 4 Drawing Sheets

HEAT EXTRACTOR DEVICE FOR FLUORESCENT LIGHTING FIXTURE

CROSS-REFERENCE TO RELATED APPLICATIONS

This application claims the benefit of U.S. Provisional Application Ser. No. 60/721,890, filed Sep. 28, 2006.

BACKGROUND OF INVENTION

The present invention generally relates to fluorescent lighting fixtures, and more particularly relates to techniques for optimizing the efficiency of fluorescent lighting fixtures by optimizing the cold spot temperature of the fixture's fluorescent lamps. The present invention has particular applicability to indirect and direct/indirect fluorescent lighting fixtures using compact fluorescent lamps such as T5 and T5HO lamps, collectively referred to herein as T5 lamps.

It is well known that T5 fluorescent lamps operate at their greatest efficiency when the cold spot of the lamp at the end of the fixture is at approximately 45° C. In open fixtures, such as totally indirect fixtures, the lamp's cold spot generally runs below the optimum temperature, typically about 38° C. to 40° C. In these types of fixtures, special sleeves have been devised to increase the lamp's cold spot temperature to a temperature closer to the optimum operating temperature. However, in other types of fixtures, such as multi-lamp wall wash T5 fixtures and down light T5 fixtures, the cold spot of the lamps generally runs at a temperature that is higher than the optimum operating temperature. For example, it has been found that in certain multi-lamp T5 wall wash fixtures, the cold spot of the lamps will heat up to about 55° C. In these types of fixtures, the normal operating temperature of the T5 lamps is elevated because the lamps of the fixtures are normally closer together, and because the heat generated by the lamp normally is trapped within the fixture. Thus, in these types of fixtures, heat needs to be extracted from the cold spot end of the lamp in order to bring the cold spot temperature down, if the lamps are to be run at optimum efficiency. On the other hand, the heat extraction should not be so great as to excessively lower the lamp's temperature beyond its optimal operating temperature.

A need therefore exists for a means for lowering the cold spot temperature of fluorescent lamps, such as T5 fluorescent lamps, in fluorescent lighting fixtures where the construction of the lighting fixture and the configuration of the lamps causes the cold spot temperature of the lamps to rise above the lamps' optimum operating temperature. A need also exists for a means for lowering the cold spot of the lamps in such fixtures only by the degree necessary to achieve optimum operating temperatures. Since such needs often arise in lighting fixtures using two or more fluorescent lamps grouped closely together a need also exists for a means for efficiently extracting heat from such groups of lamps.

SUMMARY OF THE INVENTION

The present invention provides a lamp heat extractor device for lowering the cold spot temperature of a fluorescent lamp, such as a T5 lamp where the cold spot is located at one end of the lamp behind the lamp's electrode (sometimes called the "cold chamber"). The heat extractor device includes a base portion adapted to be attached to a heat conductive portion of the fluorescent lighting fixture proximate the lamp socket or lamp sockets of the fixture that hold the cold spot end of the fixture's fluorescent lamp or lamps. An extended sleeve end portion is thermally and structurally connected to the base portion by a connector portion. The extended sleeve end portion has a contacting surface area which is positioned by the connector portion so as to contact the cold spot end of the fluorescent lamp or lamps held by the lamp sockets of the fixture to which the heat extractor is attached. This contact between the extended sleeve end portion of the heat extractor and the lamps allow heat transfer from the lamp's cold spot end to the heat extractor, and into the heat conductive portion of the fixture housing to which the heat extractor is attached.

The base portion, extended sleeve end portion, and connector portion of the heat extractor device are fabricated of a thermally conductive material, preferably aluminum, and suitably the heat extractor is a unitary part having a uniform cross-section which can be made using an extrusion process.

In one aspect of the invention, the extended sleeve end portion of the heat extractor device of the invention is comprised of at least one open, semi-cylindrical extended sleeve end having an inner diameter corresponding to the diameter of the tubular cold spot end of the fluorescent lamp to be contacted by the device, such that the extended sleeve end contacts the cold spot end of the lamp about a significant portion of the lamp's circumference.

In another aspect of the invention, the extended sleeve end portion of the heat extractor device has an outer surface with at least one and preferably a plurality of radially extending fins for increasing surface area for heat radiation from the extended sleeve portion, thereby increasing the overall heat extracting efficiency of the device.

In still a further aspect of the invention, the heat extractor device is comprised of at least two extended sleeve ends, each of which has a contacting surface area positioned for contacting the cold temperature ends of at least two fluorescent lamps held by adjacent lamp sockets of the fluorescent lighting fixture. In this embodiment of the invention, the connector portion of the heat extractor device interconnects the at least two extended lamp contacting sleeve ends to the base end of the device, such that heat from the cold spot ends of the fluorescent lamps contacted by the sleeve ends of the heat extractor device is transferred to the base end of the device and into the heat conductive portion of the lighting fixture to which the base end is connected.

It is therefore seen that a primary object of the invention is to provide an efficient extracting device for conducting heat away from the cold spot temperature ends of fluorescent lamps of a lighting fixture where it is necessary to lower the cold spot temperature for optimum operating efficiency of the lamps. It is another object of the invention to provide a heat extractor device that, in at least one embodiment, can be attached to a heat conductive portion of the lighting fixture housing for conducting heat from the cold spot ends of the fixture lamps to the fixture housing. It is a further object of another embodiment of the invention to provide a heat extractor device for a fluorescent lamp that, in one embodiment, can simultaneously conduct heat away from the cold spot ends of more than one lamp of two or more lamps of a multi-lamp fluorescent lighting fixture. Still other objects of the invention will be apparent from the following specification and claims.

DETAILED DESCRIPTION OF ILLUSTRATED EMBODIMENT

Figure 1:
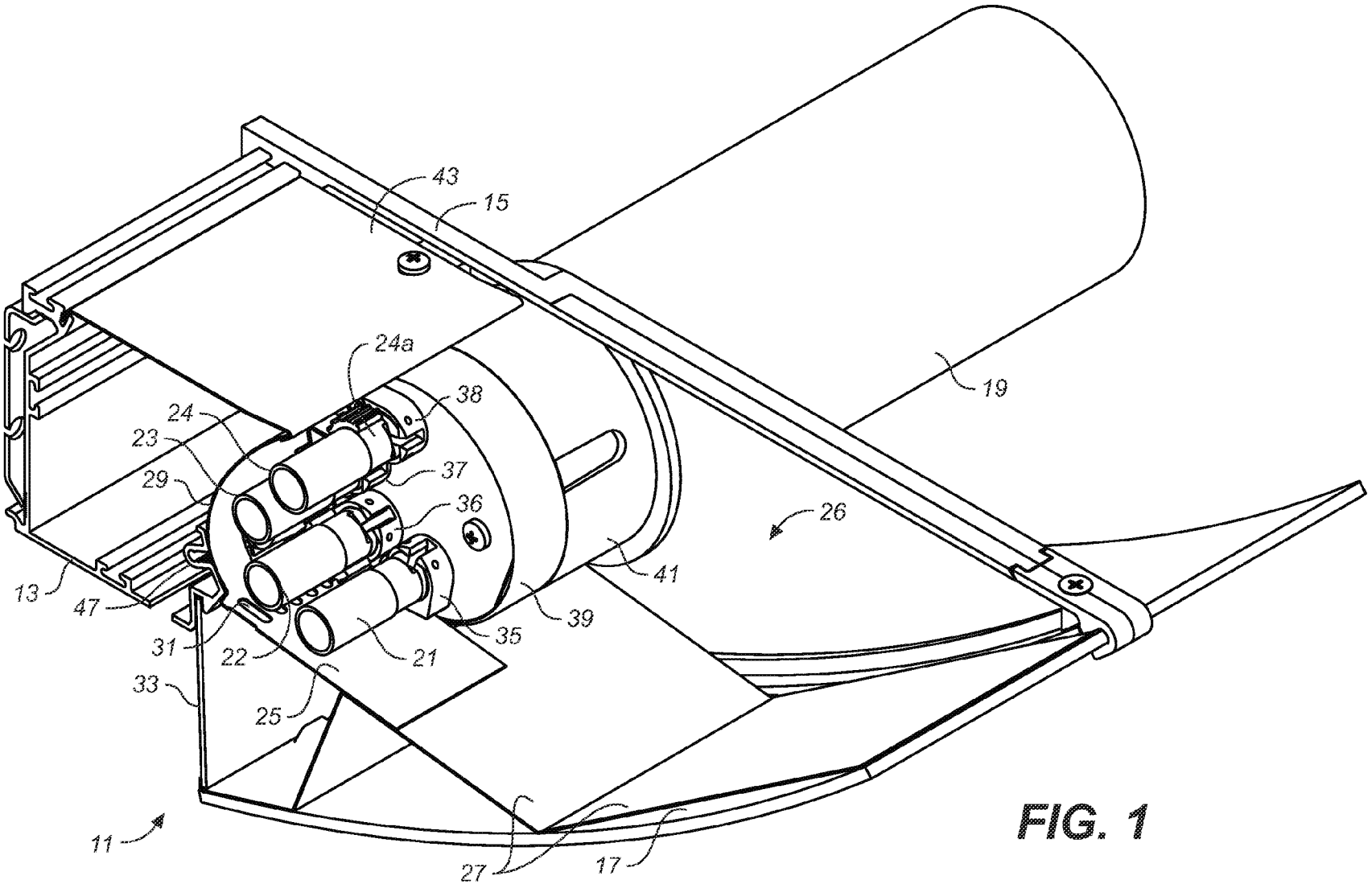
FIG. 1 is a top perspective sectional view showing a portion of a fluorescent wall wash lighting fixture having four fluorescent lamps and a heat extractor device in accordance with the invention for extracting heat from the cold spot ends of three of the four fluorescent lamps of the fixture.
Figure 2:
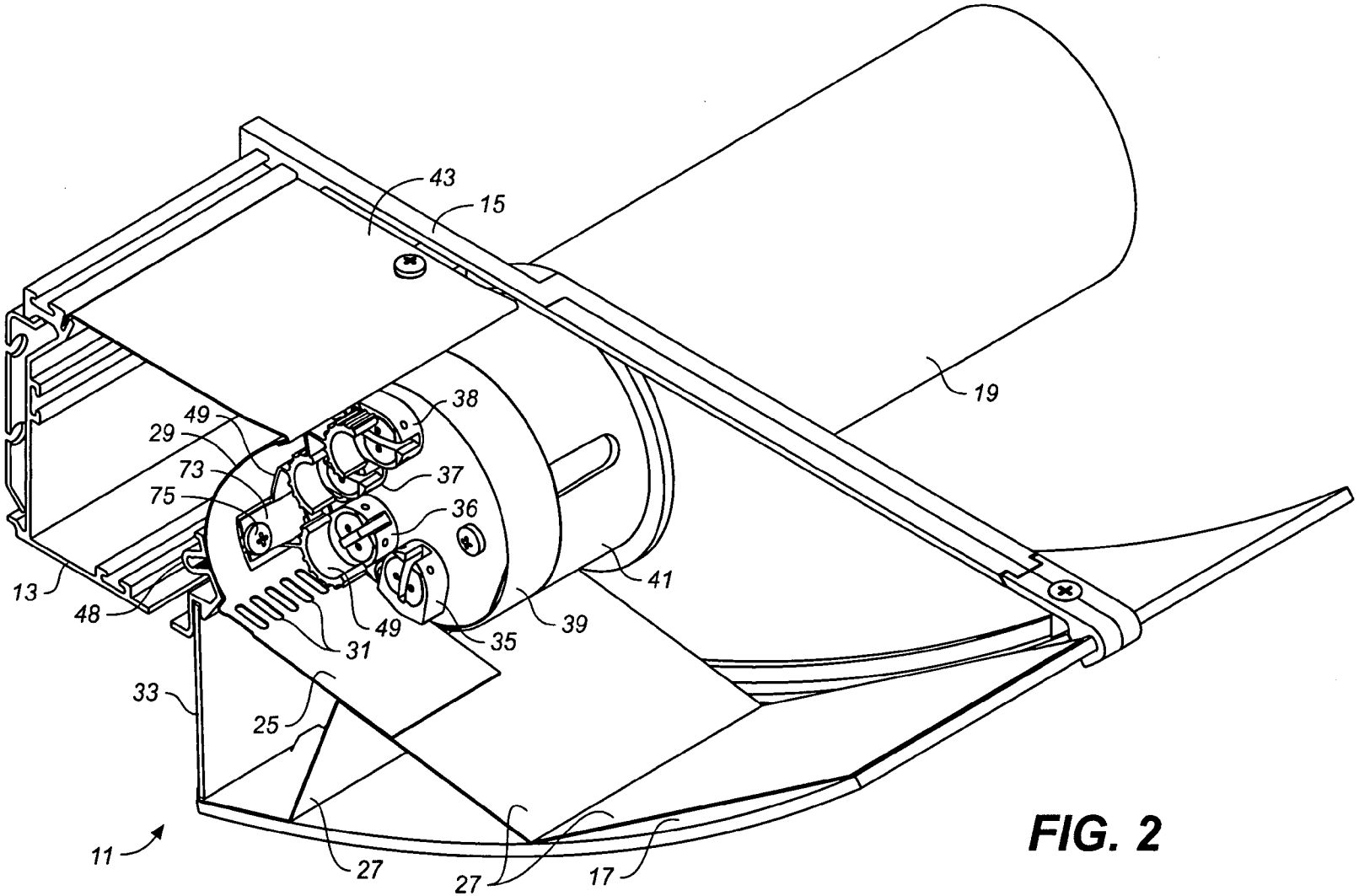
FIG. 2 is a top perspective view thereof, with the fluorescent lamps of the fixture removed.
Figure 3:
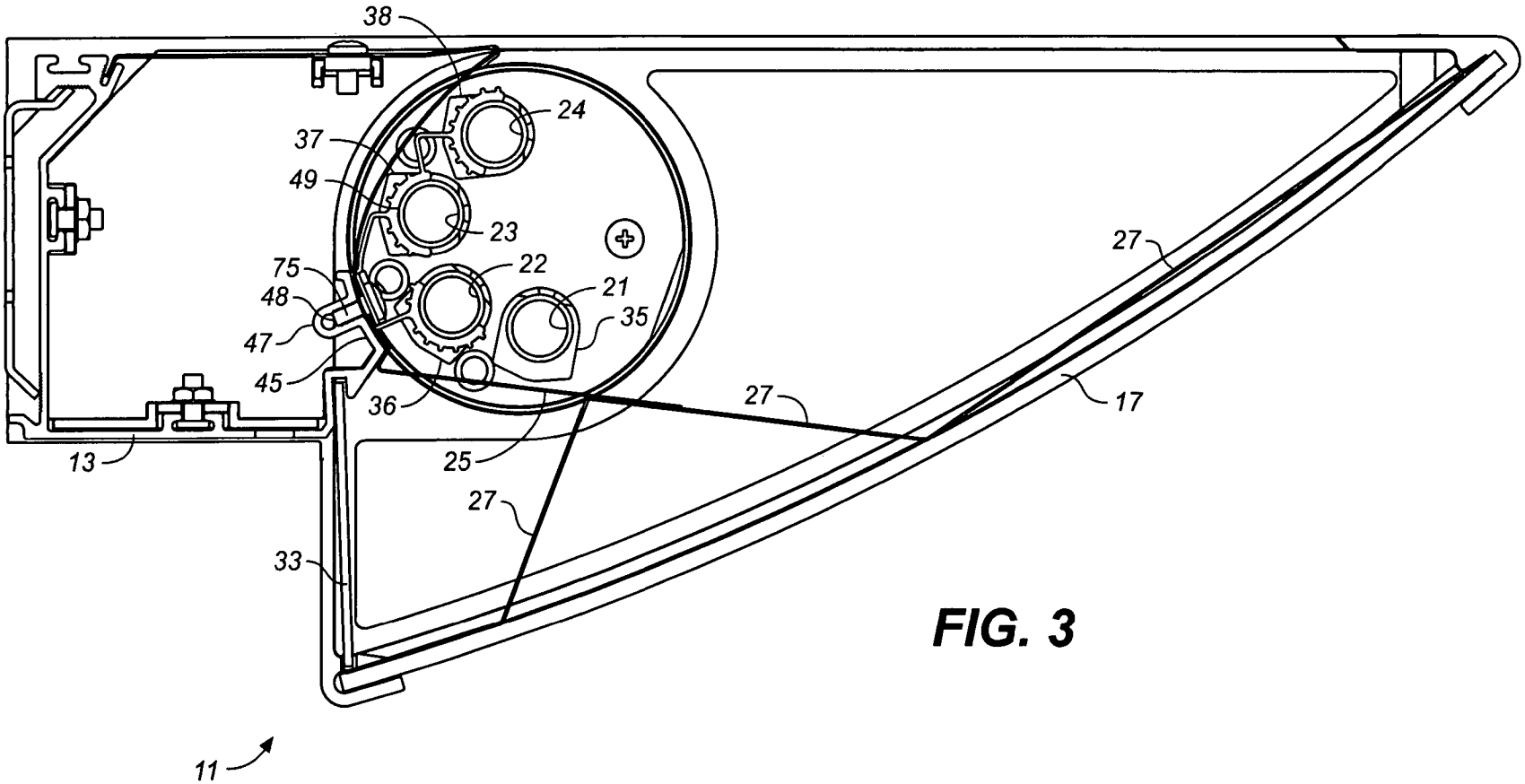
FIG. 3 is a side elevational view of the cross section of the fixture shown in FIG. 1.

Referring now to the drawings, FIGS. 1-3 illustrate a fluorescent lighting fixture of the type in which the heat extractor device of the invention can be used. The fixture illustrated in FIGS. 1-3 is a four lamp T5 wall wash lighting fixture, where the close grouping of the lamps will cause the lamp' cold spot temperature to elevate above their optimum operating temperature of 45° C. The wall wash fixture illustrated in FIGS. 1-3 is exemplary of the types of fixtures in which the heat extractor device of the invention can be used. Other examples of fixtures in which the invention might be used include down light fixtures where the cold spot temperatures of the lamp generally run high, and in some direct/indirect multi-lamp fluorescent lighting fixtures, where the fixture geometry might trap sufficient heat from the lamps to elevate the lamps cold spot temperature. The heat extractor device of the invention may not be suitable for fluorescent lighting fixtures that trap large amounts of heat and that elevate lamp temperatures beyond the capacity of a device that extracts heat purely by conduction and radiation as in the present invention, such as fully enclosed lighting fixtures.

For illustration purposes, FIGS. 1-3 show only one end of a linear wall wash fluorescent lighting fixture, generally denoted by the numeral 11. The end of the illustrated fixture is seen to include a linear rear housing portion 13, which is suitably an extruded aluminum part, an end plate 15, a decorative curved front wall 17, and a decorative tube end 19 extending from end plate. The fixture is designed to hold four T-5fluorescent lamps 21, 22, 23, 24 above and in front of reflector plates 25, 27. It is noted that the inner reflector plate 25 includes a curved back wall 29, and has a series of parallel slots 31 extending along the length of the reflector at the foot of the curved back wall. The presence of slots 31 allow some of the light from the lamps 21, 22, 23, 24 to be directed onto the vertical back wall 33 of the fixture, which is provided in the form of a white opal diffuser. The result is that, while the wall above the fixture is washed with light reflected from reflector 27 through the fixture's top opening 26, some light will be emitted through the back wall of the fixture to illuminate wall surfaces below the fixture.

The four fluorescent lamps 21, 22, 23, 24 are held by four lamp sockets 35, 36, 37, 38 mounted to the end cap 39 of tubular socket mounting structure 41. The rear housing portion 13, which provides the structure for housing the fixture's ballast and associated wiring (not shown) is covered by a suitable bent metal cover 43, which hooks over the top of the curved portion 29 of the slotted reflector 25.

The rear housing portion 13 of the illustrated wall wash fixture is further seen to include an upwardly extending interior wall 45, having a longitudinally extending extruded screw channel 47, which can be used to anchor the heat extractor device of the invention, denoted by the numeral 49, to the fixture as hereinafter described. The rear housing of the fixture, which is a metal part, is heat conductive, and will act as a heat sink for heat extractor device 49.

Figure 6:
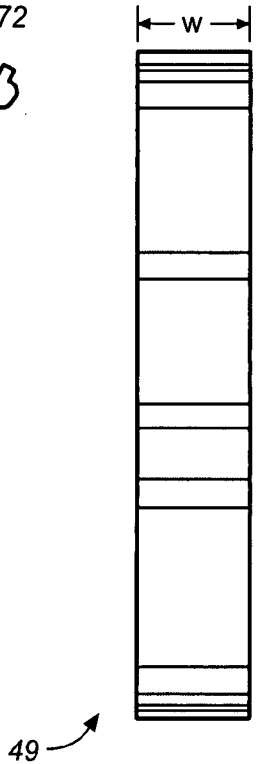
FIG. 6 is a front elevational view thereof.
Figure 5:
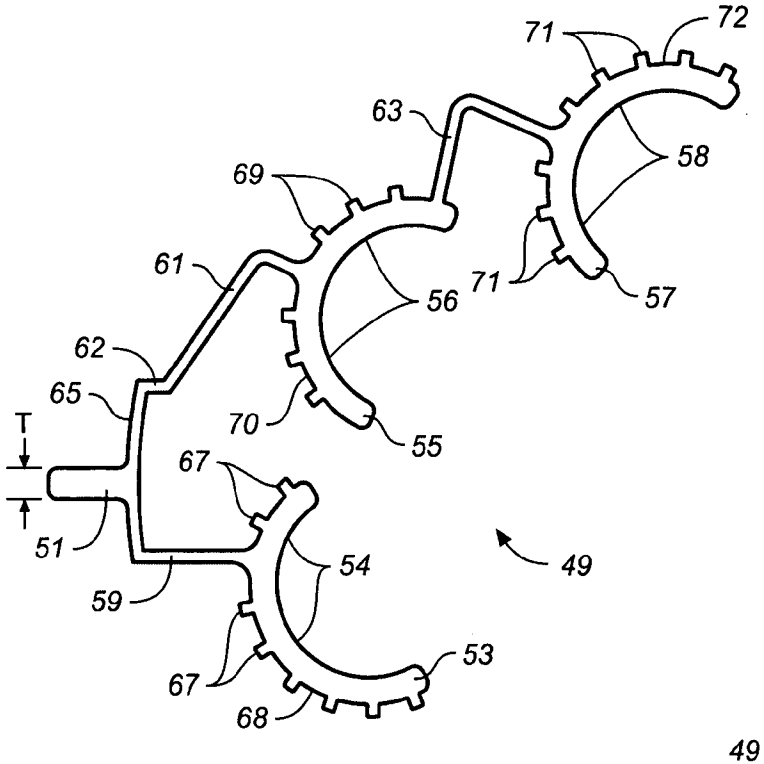
FIG. 5 is a side elevational view thereof.
Figure 4:
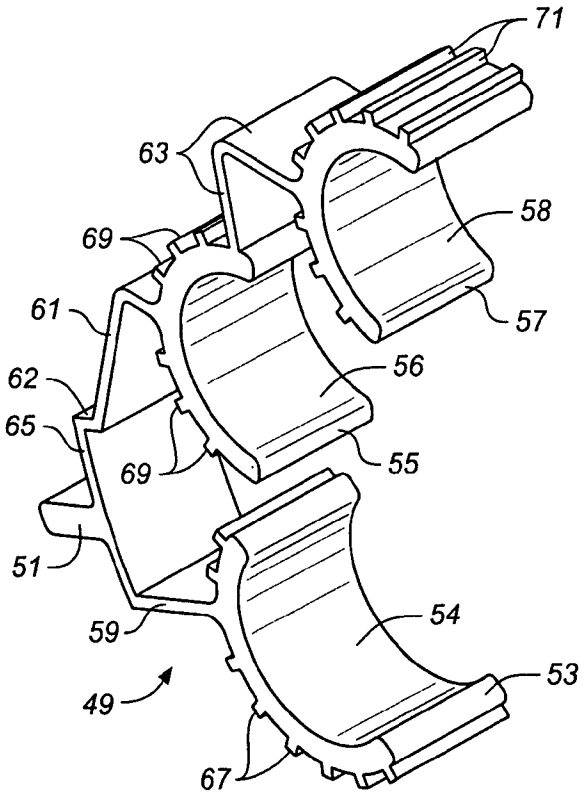
FIG. 4 is a top perspective view of the heat extractor device of the invention shown in FIGS. 1-3.

The heat extractor device of the invention is shown in greater detail in FIGS. 4-6. Referring to these figures, heat extractor 49 includes a base portion 51 having a rear projecting base wall or tab with a thickness, T, that corresponds to the width of the channel opening 48 of the rear housing's screw channel 47 to allow the base wall to be inserted into this channel opening. When inserted into the channel opening, the base portion of the heat extractor device contacts the rear housing of the fixture to provide for heat transfer between the heat extractor and the housing.

The heat extractor device 49 further includes an extended sleeve end portion comprised of three semi-cylindrical open sleeve ends 53, 55, 57 having an inner radius corresponding to the radius of the cold spot ends of the fluorescent lamps of the lighting fixture, such as cold spot end 24*a* of lamp 24 shown in FIG. 1. For T-5lamps, the width of the heat extractor, denoted "W" in FIG. 6, and hence the width of the extended open sleeve ends, is suitably about ⅜ inch, which corresponds to the length of the metallic ends of the lamps contacted by the sleeve ends. (The lamp's cold spot is inside this metallic end.) Also for T-5lamps, the inner radius of the open sleeve ends is suitably about 0.310 inches. The inner radius preferably has a close enough tolerance, suitably about 0.005 inches, which will insure contact between the lamp end and the heat extractor's open sleeve ends over substantially the entirety of the sleeve end's contact surfaces 54, 56, 58.

Each of the extended open sleeve ends 53, 55, 57 are connected to the base portion 51 of heat extractor 49 by a connector portion comprised of connecting walls 59, 61, 63. This connector portion is intended to provide a thermal connection between the sleeve ends and the base portion, as well as a structural connection. Sleeve ends 55, 57 are seen to be cascaded together. More specifically, bent connecting wall 63 connects the topmost extended sleeve end 57 to the intermediate sleeve end 55 to provide a thermal path from the topmost sleeve end to this intermediate sleeve end and to further provide the correct spacing between these two sleeve ends for positioning the sleeve ends in front of desired lamp sockets of the fixture. Connecting walls 59, 61, 63 in turn, connect extended sleeve ends 53, 55 to the heat extractor's base end 51 through a bottom channel wall 65. Bottom channel wall 65 together with perpendicular connecting wall 59 and the short perpendicular connector wall 62 form a shallow channel portion at the base portion of the heat extractor device. As hereinafter described, this channel is useful in holding the heat extractor onto the rear housing's screw channel 47.

The heat extractor device of the invention must be fabricated out of a heat conductive material in order that the device can conduct heat away from the fixture lamps to the device's base portion 51. The device is most suitably fabricated of aluminum, but it is contemplated that it could also be made of copper. Also, the device will preferably have a uniform cross-sectional shape as illustrated in the drawings, such that it can be fabricated from an extrusion.

It is further noted that, in addition to conveying heat from the extended sleeve ends to the base portion of the device, the device will also radiate a certain amount of heat from the device's exposed surfaces. To increase surface area, and hence radiation efficiency, radially extending ribs 67, 69, 71 are added to the outside surfaces 68, 70, 72 of each of the extended sleeve ends 53, 55, 57.

Referring again to FIGS. 1-3, the heat extractor device 49 is installed in the wall wash lighting fixture 11 by inserting the device's base wall 51 into screw channel opening 48 of the screw channel 47 on the fixture's rear housing interior wall 45, and sliding the device to a position just forward of the lamp sockets 35, 36, 37, 38, which are mounted to end cap 39.

As best illustrated in FIG. 2, the heat extractor is secured in this position by a rigid metal strap 73 held down against the heat extractor's bottom channel wall 65 by attachment screw 75, which screws into screw channel opening 48. When properly positioned, the connector portion connecting the base portion of the heat extractor to the extended sleeve ends 53, 55, 57 are designed such that each of the sleeve ends are positioned immediately in front of one of the lamp sockets. By inserting the cold spot ends of the lamps into the lamp sockets 36, 37, and 38 , as shown in FIG. 1, the cold spot ends of the lamps insert into and will be contacted by the semi-cylindrical interior contact surfaces 54, 56, 58 of the device's extended sleeve ends 53, 55, 57. It is noted that the heat extractor device does not contact all four lamps of the illustrated wall wash fixture 11. This is because the outer lamp 21 is more exposed to air and already operates at an optimum temperature.

While the illustrated embodiment of the heat extractor device of the invention shows an extended sleeve end portion having three sleeve ends for contacting the cold temperature end of three fluorescent lamps, it will be understood that the invention is not limited to a heat extractor device having a three lamp contacting configuration. It is contemplated that the heat extractor device of the invention will have at least one open sleeve end for contacting the cold spot end of at least one fluorescent lamp of a fluorescent lighting fixture. Generally, for a multi-lamp fluorescent lighting fixture, it will be desirable to at least provide contact with, and heat extraction from, the cold spot ends of those lamps which tend to operate at the highest temperature. Usually these will be the lamps with the least space for air circulation about the lamp.

While the present invention has been described in considerable detail in the foregoing specification, it shall be understood that it is not intended that the invention be limited to such detail, except as necessitated by the following claims.

What We claim is:

1. A heat extractor device for a fluorescent lighting fixture having at least one fluorescent lamp with a metallic cold spot end and at least one cold spot end lamp socket for holding the metallic cold spot end of the fluorescent lamp, said heat extractor device comprising a base portion for mounting the device to a heat conductive portion of the lighting fixture proximate the at least one cold spot end lamp socket of the lighting fixture, an extended sleeve end portion having a contacting surface for contacting the metallic cold spot end of a fluorescent lamp held by said cold spot end lamp socket so as to allow heat transfer from the metallic cold spot end of the lamp to said sleeve end portion, said extended sleeve end portion having a narrow width wherein the sleeve end portion substantially only contacts the metallic cold spot end of the fluorescent lamp, and a connector portion thermally interconnecting said extended sleeve end portion and said base portion, and positioning said extended sleeve end portion relative to said base portion to allow the contacting surface of the sleeve end portion to contact the metallic cold spot end of the lamp held in the lighting fixture by the cold spot end lamp socket, said base portion, extended sleeve end portion and connector portion having substantially the same width and being a unitary part fabricated of a thermally conductive material, whereby at least a portion of the heat transferred from the lamp to the extended sleeve end portion is conducted away from the contacted metallic cold spot end of the fluorescent lamp through the connector portion and base portion to the heat conductive portion of the lighting fixture to which the heat extractor device is mounted.

2. The heat extractor device of claim 1 wherein the metallic cold spot end of the fluorescent lamp contacted by said extended sleeve end portion is tubular in shape, and wherein said extended sleeve end portion is comprised of at least one open, semi-cylindrical sleeve end having an inner radius corresponding to the radius of the metallic cold spot end of the fluorescent lamp for contacting the metallic cold spot end of the lamp about a portion of its circumference.

3. The heat extractor device of claim 1 wherein said extended sleeve end portion has an outer exterior surface, and wherein said outer exterior surface has a plurality of heat radiating fins for increasing surface area for heat radiation from said extended sleeve end portion.

4. The heat extractor device of claim 1 wherein the lighting fixture to which the device is attached has an end with at least two lamp sockets for holding the metallic cold spot end of at least two fluorescent lamps, wherein said extended sleeve end portion is comprised of at least two extended sleeve ends, each having a contacting surface area positioned for contacting the metallic cold spot end of a different fluorescent lamp held in the lamp sockets of the lighting fixture so as to allow heat transfer from the metallic cold spot ends of the different fluorescent lamps to said sleeve ends, and wherein said connector portion thermally interconnects said extended sleeve ends to the base portion of the device.

5. The heat extractor device of claim 4 wherein the metallic cold spot ends of each of the fluorescent lamps contacted by said extended sleeve ends is tubular in shape, and wherein each of said extended sleeve ends is an open, semi-cylindrical sleeve end having an inner diameter corresponding to the diameter of the tubular shaped metallic cold spot end of the fluorescent lamp which it contacts.

6. The heat extractor device of claim 4 wherein each of the extended sleeve ends has an outer exterior surface, wherein the outer exterior surface of at least one of said open sleeve ends has a plurality of heat radiating fins for increasing surface area for heat radiation from said extended sleeve end portion.

7. The heat extractor device of claim 6 wherein the outer surface of each of said sleeve ends has a plurality of heat radiating fins for increasing surface area for heat radiation from said extended sleeve end portion.

8. The heat extractor device of claim 4 wherein at least two extended sleeve ends are cascaded together, such that one of said sleeve ends is an intermediate sleeve end and the other of said sleeve ends is an outer sleeve end which connects to the intermediate sleeve end, whereby the outer sleeve end is thermally connected to the base portion through the intermediate sleeve end.

9. The heat extractor device of claim 1 wherein said base portion, extended sleeve end portion and connector portion are fabricated of an aluminum.

10. The heat extractor device of claim 1 wherein said base portion, extended sleeve end portion and connector portion are fabricated of a copper.

11. The heat extractor device of claim 1 wherein said device is for mounting in a lighting fixture having at least one screw channel, and wherein said base portion has a rear projecting base wall sized for insertion into the screw channel of the lighting fixture housing.

12. The heat extractor device of claim 1 wherein said base portion, extended sleeve end portion, and connector portion are formed as a unitary part having a uniform cross-section.

13. The heat extractor device of claim 12 wherein said unitary part has a uniform width approximately corresponding to the width of the metallic cold spot end of the fluorescent lamp held by said cold spot end lamp socket.

14. A heat extractor device for a fluorescent lighting fixture having at least one fluorescent lamp with a tubular metallic cold spot end and a cold spot end lamp socket for holding the cold spot end of the lamp, said heat extractor device comprising a base portion for mounting to a heat conductive portion of the lighting fixture proximate the at least one cold spot end lamp socket of the lighting fixture, at least one extended open sleeve end having an inner radius corresponding to the radius of the cold spot end of the fluorescent lamp for contacting the metallic cold spot end of the lamp about a portion of its circumference, said extended open sleeve end having a width approximately corresponding to the width of the metallic cold spot end of the fluorescent lamp contacted thereby, and a connector portion thermally interconnecting said open sleeve end and base portion, and positioning said extended sleeve end relative to said base portion to allow the contacting surface of said open sleeve end to contact the cold spot end of the lamp held in the lighting fixture by the cold spot end lamp socket, said base portion, extended open sleeve end and connector portion having substantially the same width and being a unitary part fabricated of a thermally conductive material, whereby at least a portion of the heat transferred from the lamp to the extended sleeve end is conducted away from the contacted metallic cold spot end of the fluorescent lamp through the connector portion and base portion to the heat conductive portion of the lighting fixture to which the heat extractor device is mounted.

15. The heat extractor device of claim 14 wherein said open sleeve end has an outer exterior surface, and wherein said outer exterior surface having a plurality of heat radiating fins for increasing surface area for heat radiation from said sleeve end.

16. The heat extractor device of claim 14 wherein the lighting fixture to which the device is attached has an end with at least two lamp sockets for holding the metallic cold spot end of at least two fluorescent lamps, and wherein the heat extractor device has at least two extended open sleeve ends, each having a contacting surface area positioned for contacting the metallic cold spot end of a different fluorescent lamp held in the lamp sockets of the lighting fixture so as to allow heat transfer from the cold spot ends of the different fluorescent lamps to said sleeve ends, and wherein said connector portion interconnects said extended open sleeve ends to the base end of the device.

17. The heat extractor device of claim 16 wherein said extended open sleeve ends each have an outer exterior surface, and wherein the outer exterior surface of each of said sleeve ends having a plurality of heat radiating fins for increasing surface area for heat radiation from said sleeve end.

18. The heat extractor device of claim 16 wherein said at least two open sleeve ends are cascaded together, such that one of said sleeve ends is an intermediate sleeve end and the other of said sleeve ends is an outer sleeve end which connects to the intermediate sleeve end, whereby the outer sleeve end is thermally connected to the base portion through the intermediate sleeve end.

19. A heat extractor device for a fluorescent lighting fixture having at least one fluorescent lamp with a metallic cold spot end and a cold spot end lamp socket for holding the cold spot end of the lamp and further having at least one internal heat conductive screw channel in proximity to the at least one cold spot end lamp socket of the fixture, said heat extractor device comprising a base portion including a rear projecting base wall for insertion into the screw channel of the lighting fixture housing proximate the at least one cold spot end lamp socket of the lighting fixture, an extended sleeve end portion having a contacting surface for contacting the metallic cold spot end of a fluorescent lamp held by said cold spot end lamp socket so as to allow heat transfer from the metallic cold spot end of the lamp to said sleeve end portion, said extended sleeve end portion having a width approximately corresponding to the width of the metallic cold spot end of the fluorescent lamp contacted thereby, and a connector wall portion thermally interconnecting said extended sleeve end portion and base end, and positioning said extended sleeve portion relative to said base portion to allow the contacting surface of the extended sleeve end portion to contact the metallic cold spot end of the lamp held in the lighting fixture by the cold spot end lamp socket, said base portion, extended sleeve end portion and connector wall portion having substantially the same width and being fabricated of a thermally conductive material, whereby at least a portion of the heat transferred from the lamp to the extended sleeve portion is conducted away from the metallic cold spot end of the fluorescent lamp through the connector portion and base portion to the heat conductive screw channel of the lighting fixture to which the heat extractor device is mounted.

20. The heat extractor device of claim 19 wherein the lighting fixture to which the device is attached has an end with at least two lamp sockets for holding the metallic cold spot end of at least two fluorescent lamps, and wherein the extended sleeve portion is in the form of at least two extended open sleeve ends thermally interconnected to the base portion by connector walls, said connector walls positioning each of said sleeve ends for contacting the metallic cold spot end of a different fluorescent lamp held in the lamp sockets of the lighting fixture so as to allow heat transfer from the metallic cold spot ends of the different fluorescent lamps to said sleeve ends.

21. The heat extractor device of claim 20 wherein said base portion, open sleeve ends and connector walls are formed as an extruded unitary part having a uniform cross-section and a uniform width.

22. A heat extractor device for a fluorescent lighting fixture having at least two fluorescent lamps with a tubular metallic cold spot end and at least two cold spot end lamp sockets for holding the metallic cold spot end of the at least two fluorescent lamps, said heat extractor device comprising a base portion for mounting to a heat conductive portion of the lighting fixture proximate the cold spot end lamp sockets of the lighting fixture, at least two extended open sleeve ends for contacting the metallic cold spot end of each of the lamps about a portion of its circumference so as to allow heat transfer from the metallic cold spot end of the lamps to said at least two sleeve ends, each of said open sleeve ends having an inner radius corresponding to the radius of the metallic cold spot end of the fluorescent lamp which it contacts, and a width approximately corresponding to the width of the contacted metallic cold spot end, a connector portion for interconnecting said sleeve ends to said base portion, said base portion, extended sleeve ends and connector portion having substantially the same width and being a unitary part fabricated of a thermally conductive material, whereby at least a portion of the heat transferred from the metallic cold spot end of the lamp to said extended sleeve ends is transferred through the connector portion and base portion to the heat conductive portion of the lighting fixture to which the heat extractor device is mounted.

23. The heat extractor device of claim 22 wherein each of said open sleeve ends has an outer exterior surface, and wherein the outer exterior surface of at least one of said open sleeve ends has a plurality of heat radiating fins formed therein for increasing surface area for heat radiation from said sleeve end.

24. The heat extractor device of claim 22 wherein the outer surface of each of said open sleeve ends has a plurality of heat radiating fins formed therein for increasing surface area for heat radiation from said sleeve end.

25. The heat extractor device of claim 22 wherein said connector portion is in the form of connector walls connecting one open sleeve end to the other, and to said base portion.

26. The heat extractor device of claim 25 wherein at least one of said connector walls is a bent connector wall for achieving the proper positioning of at least one of said open sleeve ends.

27. The heat extractor device of claim 25 wherein said base portion includes a rear projecting base wall for insertion into a screw channel of the lighting fixture housing proximate the cold spot end lamp sockets of the lighting fixture.

28. The heat extractor device of claim 27 wherein said base portion, open sleeve ends and connector walls are formed as an extruded aluminum part.

29. The heat extractor device of claim 22 wherein the lighting fixture to which the device is attached has an end with three lamp sockets for holding the cold spot end of three fluorescent lamps, and wherein the extended sleeve portion is in the form of three extended open sleeve ends thermally interconnected to the base portion by said connector portion, said connector portion positioning each of said sleeve ends for contacting the metallic cold spot end of a different one of the three fluorescent lamp held in the lamp sockets of the lighting fixture so as to allow heat transfer from the metallic cold spot ends of the three fluorescent lamps to said three sleeve ends.

30. The heat extractor device of claim 29 wherein said connector portion connects two of the open sleeve ends one to the other, and connects the third sleeve end directly to the base portion.

31. The heat extractor device of claim 30 wherein said connector portion includes at least one bent wall connector for achieving the proper positioning of at least one of said open sleeve ends.

* * * * *

UNITED STATES PATENT AND TRADEMARK OFFICE

CERTIFICATE OF CORRECTION

PATENT NO. : 7,883,237 B2
APPLICATION NO. : 11/541425
DATED : February 8, 2011
INVENTOR(S) : John Zhang, Peter Y. Y. Ngai and Qirong Cao It is certified that error appears in the above-identified patent and that said Letters Patent is hereby corrected as shown below:

In column 1, line 8, “September 28, 2006” should read --September 28, 2005--.
In column 3, line 17, “lamp’” should read --lamps’--.
In column 3, line 26, “lamps” should read --lamps’--.
In column 3, line 39, “end plate” should read --end plate 15--.
In column 4, line 38, “of desired” should read --of the desired--
In column 5, line 7, “are designed” should read --is designed--.
In column 10, line 14, “fluorescent lamp” should read --fluorescent lamps--.

Signed and Sealed this
Fourth Day of October, 2011

David J. Kappos

David J. Kappos
*Director of the United States Patent and Trademark Office*